US008122659B2

(12) United States Patent
Davidson

(10) Patent No.: US 8,122,659 B2
(45) Date of Patent: Feb. 28, 2012

(54) QUICK-CONNECT/DISCONNECT ENVELOPING POST COVER

(76) Inventor: Bradley W. Davidson, Mission, KS (US)

( * ) Notice: Subject to any disclaimer, the term of this patent is extended or adjusted under 35 U.S.C. 154(b) by 548 days.

(21) Appl. No.: 12/248,655

(22) Filed: Oct. 9, 2008

(65) Prior Publication Data

US 2009/0039328 A1 Feb. 12, 2009

(51) Int. Cl.
*E04H 12/00* (2006.01)

(52) U.S. Cl. ..... 52/301; 292/1; 256/1

(58) Field of Classification Search ..... 52/301; 292/1, DIG. 29; 256/1
See application file for complete search history.

(56) References Cited

U.S. PATENT DOCUMENTS 3,670,468 A 6/1972 Cordell, Sr.
4,680,428 A 7/1987 Wilson, Jr.
5,022,618 A 6/1991 Barrett et al.
5,310,228 A * 5/1994 Ellenberg ..... 292/167
5,375,712 A * 12/1994 Weisburn ..... 206/387.11
5,731,895 A 3/1998 Owczarzak et al.
5,755,431 A 5/1998 Williams
5,927,694 A 7/1999 Montepiano
5,956,875 A 9/1999 Aughenbaugh
D416,335 S 11/1999 Roy
6,108,970 A 8/2000 Ball
6,330,998 B1 12/2001 Roy
D465,585 S 11/2002 Venegas, Jr.
6,612,551 B1 9/2003 Roy
6,691,479 B1 * 2/2004 Tscharner ..... 52/301
7,028,991 B2 4/2006 Egan
D554,777 S 11/2007 Roy
7,448,174 B2 * 11/2008 Krochmal et al. ..... 52/204.54

* cited by examiner

*Primary Examiner* — Jeanette E Chapman
*Assistant Examiner* — Daniel Kenny
(74) *Attorney, Agent, or Firm* — Lathrop & Gage LLP

(57) ABSTRACT

Disclosed is a cover for a conventional post, e.g., a T-post commonly used in landscaping, farming, and other fields. The cover has a partially hollow tubular body that is able to slidingly receive a post. A ratchet strip is included on the inside of the cover. Catches on the ratchet strip engage barbs on the post preventing removal. A release strap is provided which is receivable into the hollow cover. The strap comes between the catches and barbs allowing cover removal.

17 Claims, 9 Drawing Sheets

QUICK-CONNECT/DISCONNECT ENVELOPING POST COVER

BACKGROUND OF THE INVENTION

1. Field of the Invention

The disclosed embodiments relate generally to vertical post arrangements. More specifically, the post arrangements related to providing more ornamental covering s for T-posts and other widely used vertical supports.

2. Description of the Related Art

Barbed T-posts have been in use as lateral supports used to tether newly planted trees, sign posts, fence post and in numerous other applications. Covers for these posts have been developed for a number of purposes. Some examples of T-post covers include U.S. Pat. Nos. 6,612,551 issued to Roy (a plastic T-post cover); 5,956,875 issued to Aughenbaugh (a sign post arrangement involving a T-post); 5,755,431 issued to Williams (a vinyl post cover); 5,022,618 issued to Barrett et al. (a post cover for a mailbox); 3,670,468 issued to Cordell, Sr. (a T-post cover for a temporary fence); 6,330,998 issued to Roy (a plastic T-post cover); 7,028,991 issued to Egan (a lock-on cap for T-posts); 4,680,428 issued to Wilson (a post cover); 6,108,970 issued to Ball (a watering bag having a post support); D554,777 issued to Roy (a T-post cover); 6,691,479 issued to Tscharner (a T-post cover); 5,731,895 issued to Owczarzak (a post-mounted reflective cover; D416,335 issued to Roy (a T-post cover); D465,585 issued to Venegas (a stanchion cover); and 5,927,694 issued to Montepiano (a post cover).

SUMMARY

The present invention is defined by the claims below. Embodiments of the disclosed systems and methods include a system including a rigid longitudinal a rigid longitudinal member adapted to be driven into the ground and stand substantially upright; a cover that slideably receives the rigid longitudinal member into a longitudinal corridor defined in a body of the cover, the longitudinal corridor including a cross-sectional opening, the cross-sectional opening configured to correspond to cross-sectional shape of the rigid longitudinal member such that the rigid longitudinal member is receivable into the cover; the cover including a locking mechanism, the mechanism including at least one outwardly projecting member which engages at least one portion of the rigid longitudinal member to prevent detachment after the cover is installed. This embodiment also includes a release mechanism which enables disengagement of the outwardly projecting member from the portion of the rigid longitudinal member such that the cover is rendered slideably removable from the rigid longitudinal member. In some embodiments the rigid longitudinal member is a T-post.

In some embodiments the portion of the rigid longitudinal member is a T-post, and in other embodiments the outwardly projecting member is a T-post barb. In more specific embodiments, (i) the outwardly projecting member includes a plurality of outwardly projecting catches, (ii) the portion of the rigid longitudinal member comprises a plurality of outwardly extending portions, each of the which is engaged by one of the outwardly projecting catches. These catches may extend outward and upward to engaging a lower sloped face on each of the outwardly extending portions of the T-post. The catches can be included on a common strip which is mounted on an inside surface of the longitudinal corridor opposite the T-post barbs. In an embodiment, each of the catches are punched into then bent outwards from the strip, the strip being constructed of a springable metal. The cover, in embodiments, is comprised of a plastic.

These general concepts are applicable to numerous applications for T-post mounted devices. For example, a cover like that described already could be used for: (i) tethering trees; (ii) including a water reservoir in the cover along with a metering device to continually water a tree or other plant; (iii) supporting a sign; (iv) a warning marker; (v) a net barrier support; (vi) a post for a cable fence; (vii) a banner support.

In other embodiments, the disclosed systems include a T-post cover having a body; a longitudinal corridor defined in the cover, the longitudinal corridor adapted to receive a T-post into the cover; a locking mechanism on a surface including a catch, the catch having a first position in which the catch extends outward and upward so that the catch is adapted to engage a lower sloped surface of a T-post barb to prevent removal of the cover after installation; and, a release mechanism, the release mechanism being made slidable between the catch and the T-post barb to compell the catch into a second less-extended position thus disengaging the catch from the barb enabling removal of the cover. In still further embodiments the cover could include slot allowing for the insertion of the release mechanism such that the release mechanism is able to come between the catch and the barb. In embodiments the release mechanism is a flexible metal strap.

In still further embodiments the invention is a post cover having a partially hollow tubular body adapted to slidingly receive a post; a ratchet mechanism on the inside of the body including a plurality of catches, the catches adapted to engage features of a commercially available post preventing removal; and, a release strap receivable into the hollow body to come between the catches and the post thus causing disengagement of the catches for removal of the cover.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Embodiments of the present invention provide systems and methods for installing a decorative covers on posts, e.g., T-Posts in embodiments.

The disclosed is a first embodiment for a tree stake post arrangement in which an exterior enveloping cover (in one embodiment constricted mainly of a plastic, e.g., high-density polyethylene (HDPE) or other similar plastic material) is installed by mounting it over a standard T-Post like those commonly used in the fanning (e.g., as fence posts) or in landscaping fields (e.g., as a support for trees).

Figure 1:
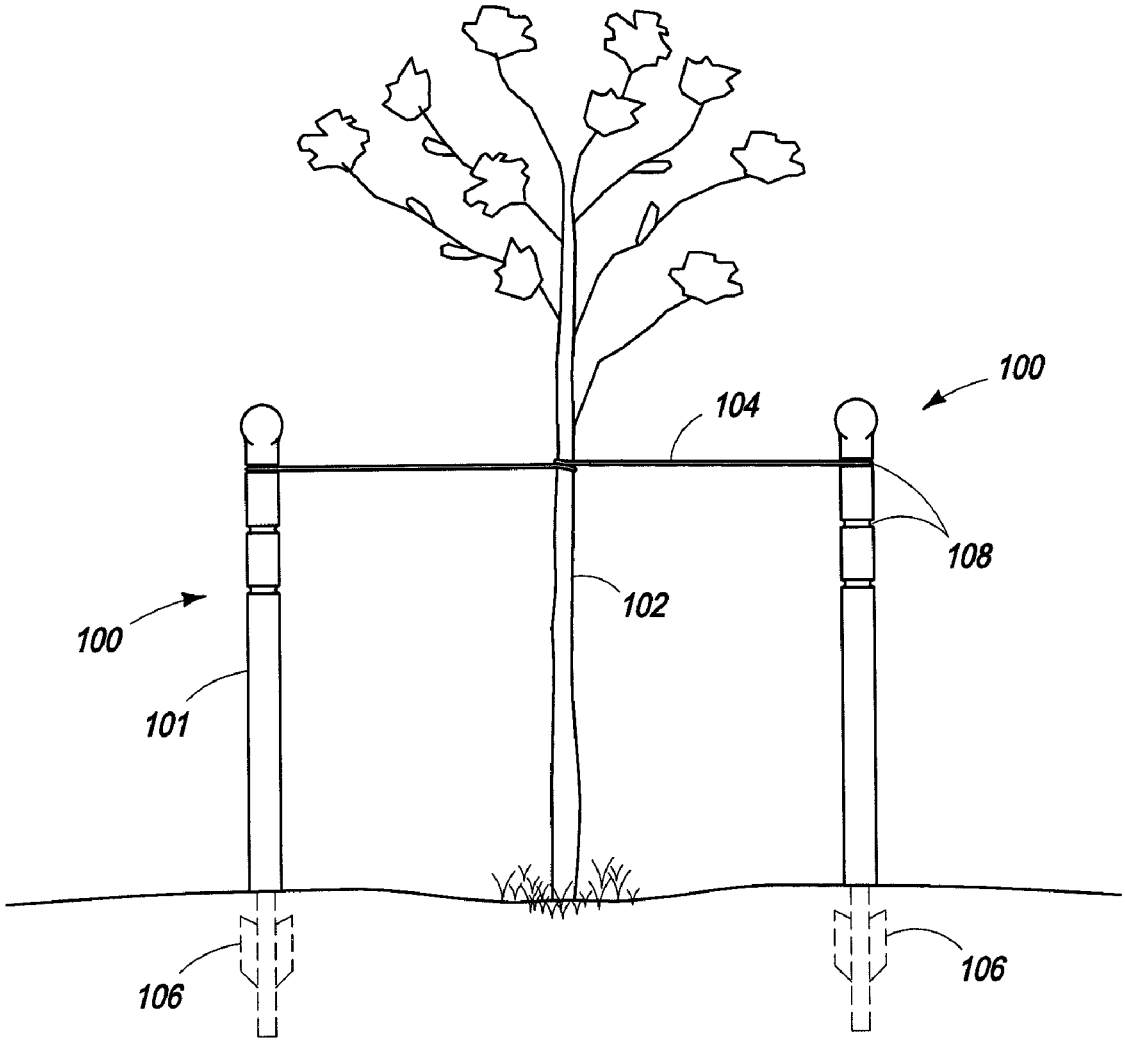
FIG. 1 is a front view showing an embodiment of the invention used as a tree support.
Figure 2A:
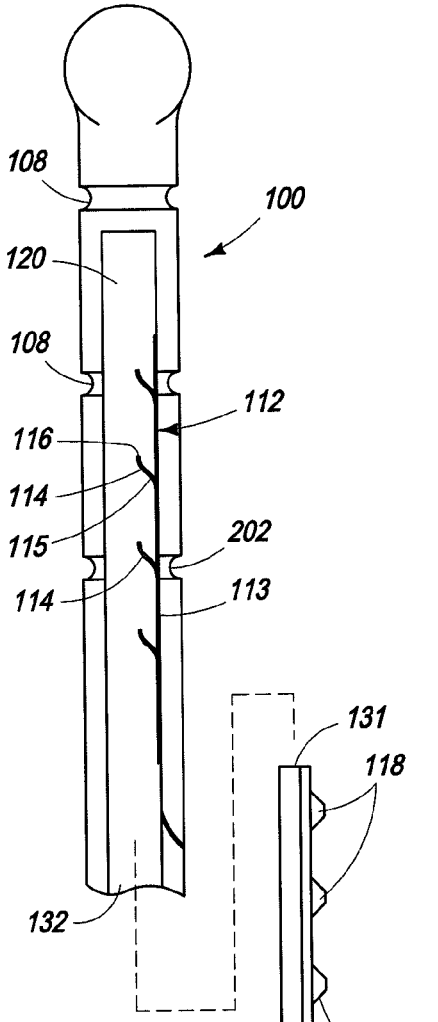
FIG. 2A shows a cross-sectional side view of an embodiment for a cover as it appears before application over a T-post and FIG. 2B shows a front view of the ratchet strip of an embodiment the disclosed device.
Figure 2B:
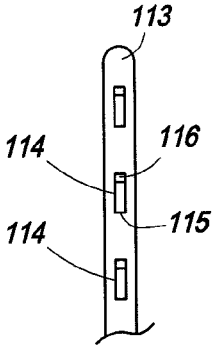

One embodiment of the invention is shown in FIGS. 1-5. Those skilled in the art will recognize that the most common way to secure a tree is to use a pair of opposing T-Posts—one on each side of the tree—and to tie a wire from each post to the tree. The object is to support the tree until it is well-rooted enough to support itself. The arrangement shown in FIGS. 1-5 is a more aesthetically pleasing alternative which uses a pair 100 of identical connectable and disconnectable enveloping covers which are, in the disclosed embodiment, ornamentally-pleasing plastic tubes 100, which may be made of plastic, and in some embodiments, HDPE. These tubes 100 are adapted to fit over a pair of predriven T-Posts 106. Referring first to FIG. 1, it can be seen that each decorative cover 100 on each side of a tree 102 is used to secure and support the tree 102 using metal wire ties 104. These conventional wire ties 104 are secured in wire seats 108 which are simply grooves on the outside of the tubes 100 as shown in FIG. 1. Also shown in FIG. 1 is that post 100 is receivable onto the top of an already installed T-Post 106.

The specifics as to how this is accomplished are revealed in FIGS. 2-5. An internal releasable ratchet system is provided which uses a ratchet strip 112. As can be seen in FIGS. 2A-B, strip 112, comprises a body 113 and a plurality of catches 114. The catches, in embodiments, are punch cut into body 113 of strip 112 to create a cut outline in the desired shape. Once the outline is punched, each of the catches 114 are bent outwards at a fold 115, and then bent back close to parallel at a termination point 116. Thus, the termination point 116 is displaced from the strip along its length, and able to act as a catch against one of a plurality of T-Post barbs 118 which are a standard part of a T-post, e.g., T-Post 106. In one embodiment, ratched strip 112 is formed from stainless steel—springable stainless steel in some embodiments.

In cross section (see FIG. 3B in which ratchet strip 112 has been removed for clarity) it can be seen that in one embodiment, a tube body 100 is formed from a first half 122 and a second half 124 which are adhered or attached to one another using fasteners to create the one solid tube which comprises tube 100. Alternatively, the body 100 could be formed integrally in some fashion. The tube body defined a longitudinal corridor up and down the device. In a first portion 120, the corridor has a T-shape which corresponds to slidingly receive a post 106. In a second portion 126, the corridor has a face 128 on which ratchet strip is installed, and an open area 130 where the engagement between the catches 114 and T-Post barbs 118 will occur.

Figure 3A:
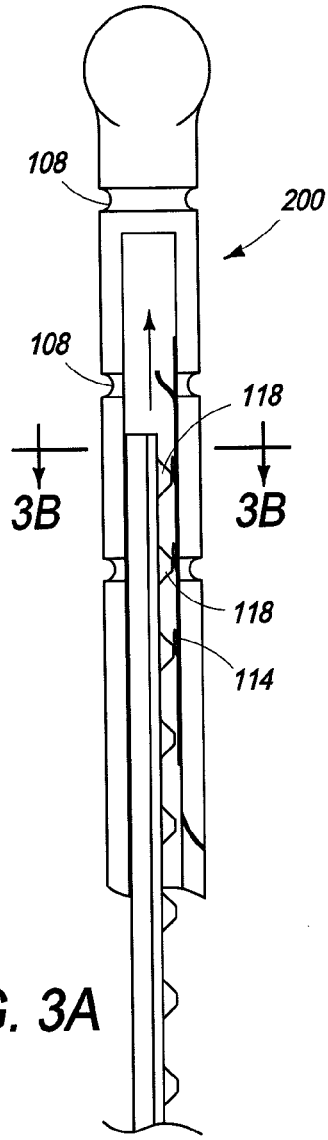
FIG. 3A shows a cross sectional of the cover of FIG. 2A as it appears after being installed onto a T-post.
Figure 3B:
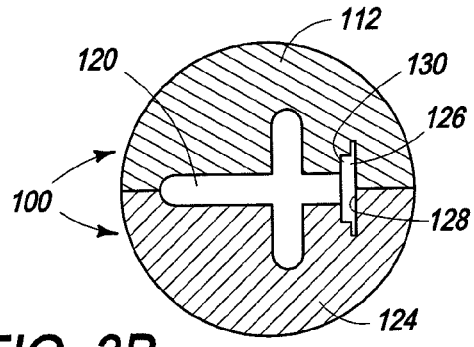
FIG. 3B shows a cross-sectional view of the cover internals with the T-post removed.
Figure 4:
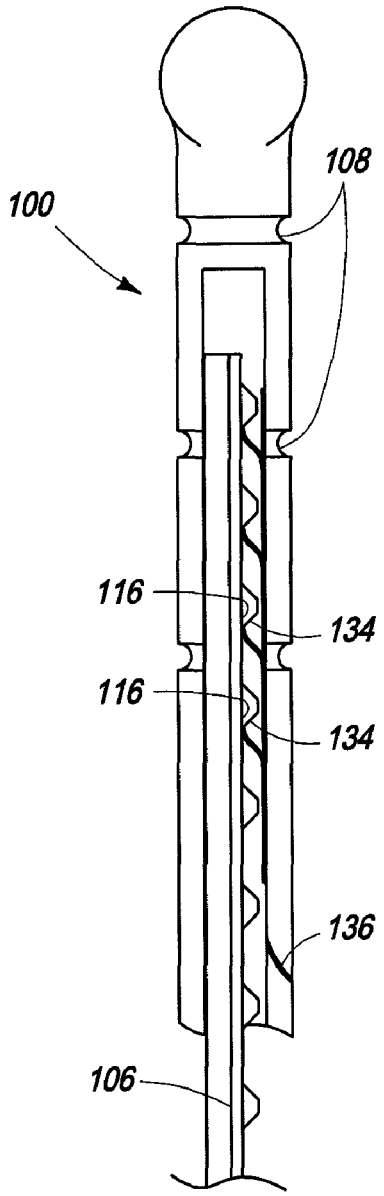
FIG. 4 is a side cross-sectional of the cover in locked position on a T-post.

In operation, to cover a post 106, the user fits a top 131 of the post 106 into an opening 132 at the bottom of tube 100, and slides tube 100 down over the post through corridor 120. When they engage the barbs 118, a clicking sound can be heard as the ratchet-catches 114 rake over the barbs. The catches go between a compressed substantially flat state when they engage the barb (as can be seen in FIG. 3A) and a released state when between barbs (see FIG. 4, for example). Once the bottom of the cover 100 engages the ground, the post is locked thereon. This is because, once the tube 100 is installed on the post 106 the terminal ends 116 will engage the lower faces 134 on each barb preventing the tube 100 from being lifted off of the post 106. This state of locked engagement is shown in FIG. 4 where the terminal ends 116 are seen engaging the lower barb surfaces 134.

Figure 5:
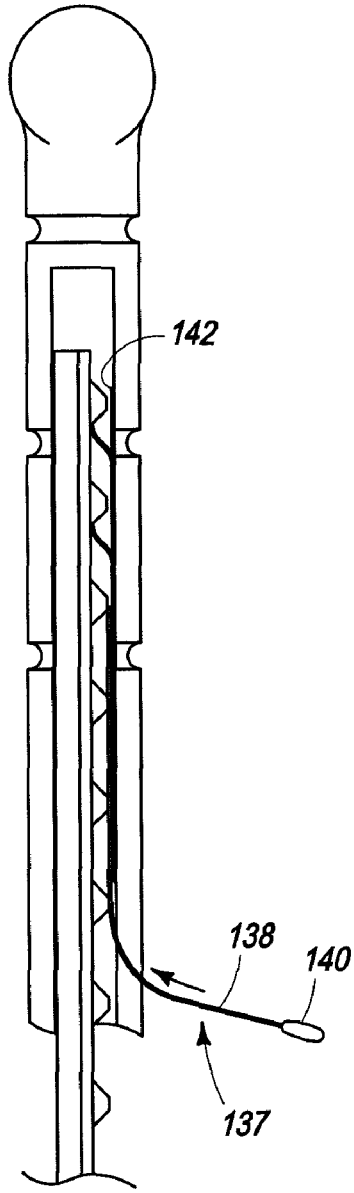
FIG. 5 is a side cross-sectional of the cover upon the insertion of a release mechanism used to disengage and remove the cover.

The tube is, however, releasable. Release is made by the use of a release system which can best be seen in FIGS. 4 and 5. Referring again to the locked state of FIG. 4 in which post 100 is already installed on a T-Post 106, an upwardly-curved slot 136 is provided for a release device 137 is shown. The beginning of the release process starts with pushing down slightly on the embodiment 100 to unload tension from the catches 114 from the T-post barb's 118. The release device 137 includes an elongated, flexible strip of metal 138, and a handle 140. A tip 142 of the device 137 is receivable into the upwardly-curved slot 136. Pushing the device 137 up into the tube 100 results in the flexible metal portion 138 sliding up through open area 130 of the corridor 126 between the catches 114 and the T-Post barbs 118 as shown in FIG. 3A, isolating the catches 114 from engagement with the T-post barbs. Once this occurs, the catches 114 are rendered substantially flat and will not interfere with the sliding of tube 100 completely off of post 106, as shown in FIG. 5.

Figure 6A:
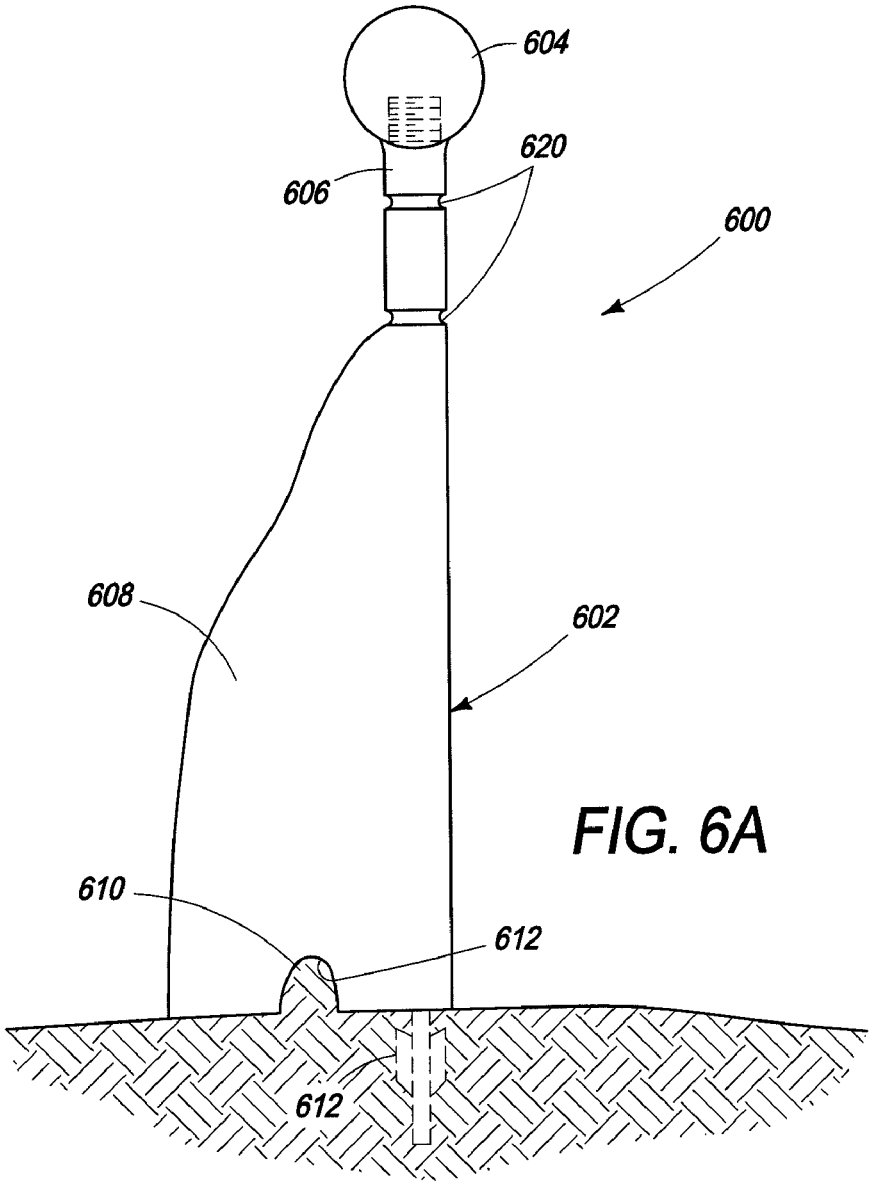
FIGS. 6A-B show a second embodiment having a water reservoir and a metered watering arrangement.
Figure 6B:
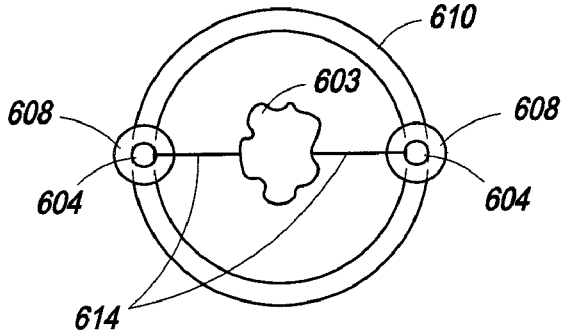

The internal system arrangement in device 100 could be used to support numerous different sorts of configurations to accomplish numerous different objectives. For example, a second embodiment is shown in FIGS. 6A-B. Referring first to FIG. 6B, a second embodiment 600 which is an enveloping cover for a tree post stake (not shown) with a water reservoir is shown. This post comprises a main body 602 and a screw cap 604 which is treadidly received onto a top portion 606 of body 602. Once screw cap 604 is removed, water may be introduced into a reservoir area 607 provided inside of body 602 in order to water a tree. A slow-drip mechanism (not shown), e.g., a metered hole or some other known arrangement at the bottom of the cover 602 will be used to gradually release water to perform a gradual time-delayed watering function. The system 600, much like the FIGS. 1-5 embodiment, is mounted on top of a T-post 612.

The post cover 602 to deliver continual watering and also makes accommodation for berms which are normally built up around a new baby tree 603 to corral water. Referring to FIGS. 6A-B, it can be seen that a berm 610 is typically built up around a tree 603 in order to pool water around the tree.

It should be understood that, although not shown in detail, the internals of body 608 would include a corridor and a ratchet system substantially identical to those shown in FIGS. 2-5 (e.g., corridor 120 adapted to receive the post; the ratchet strip 112 and catches 114 used to engage the T-post barbs; the release strap system including device 137) used to enable body 602 to be releasably secured onto a post 612. Metal wires 614 secured around outer channels 620 are used to tether tree 603 from both sides as shown in FIG. 6B.

Figure 7:
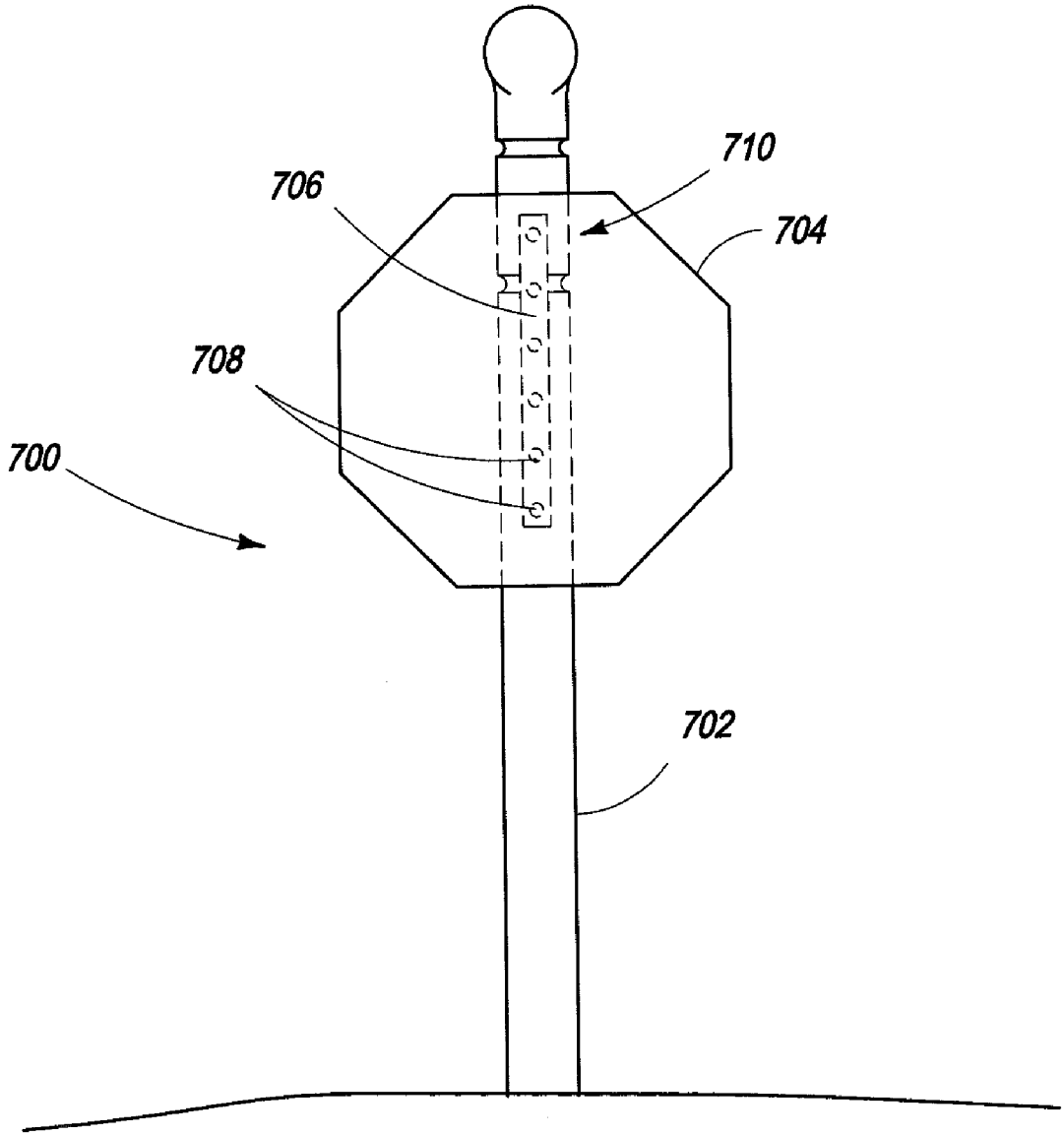
FIG. 7 shows a sign-supporting embodiment.

A third embodiment 700 shown in FIG. 7, which also incorporates an internal corridor and a ratchet system substantially identical to those shown in FIGS. 2-5; enables a sign-post body 702 to be releasably secured onto a post (not shown because underground) in which an enveloping cover 702 is used to mount street signs (e.g., sign 704). In this embodiment street sign 704 is mounted upon a forward edge of the post 702 directly. More specifically, a removed rectangular portion formed in an upper portion 710 of the post body 702 is sized to receive tapped bar 706 which is fixed therein. Thus, the vertically extending mounting bar 706 is provided on the forward edge of the post cover 702 so that a sign can be affixed by putting fasteners (e.g., screws or bolts) into two of a plurality of spaced threaded openings 708 provided. In embodiments, mounting bar 706 with threaded holes 708 is a one-inch solid piece of metal which is mounted on the front of the cover 702, as is standard in the industry since sign holes are normally spaced at 1" increments. Thus, the threaded holes 708 are adapted to be, in a preferred embodiment, one inch apart from one another so as to match the common spacing used to mount signs in the industry.

Figure 8:
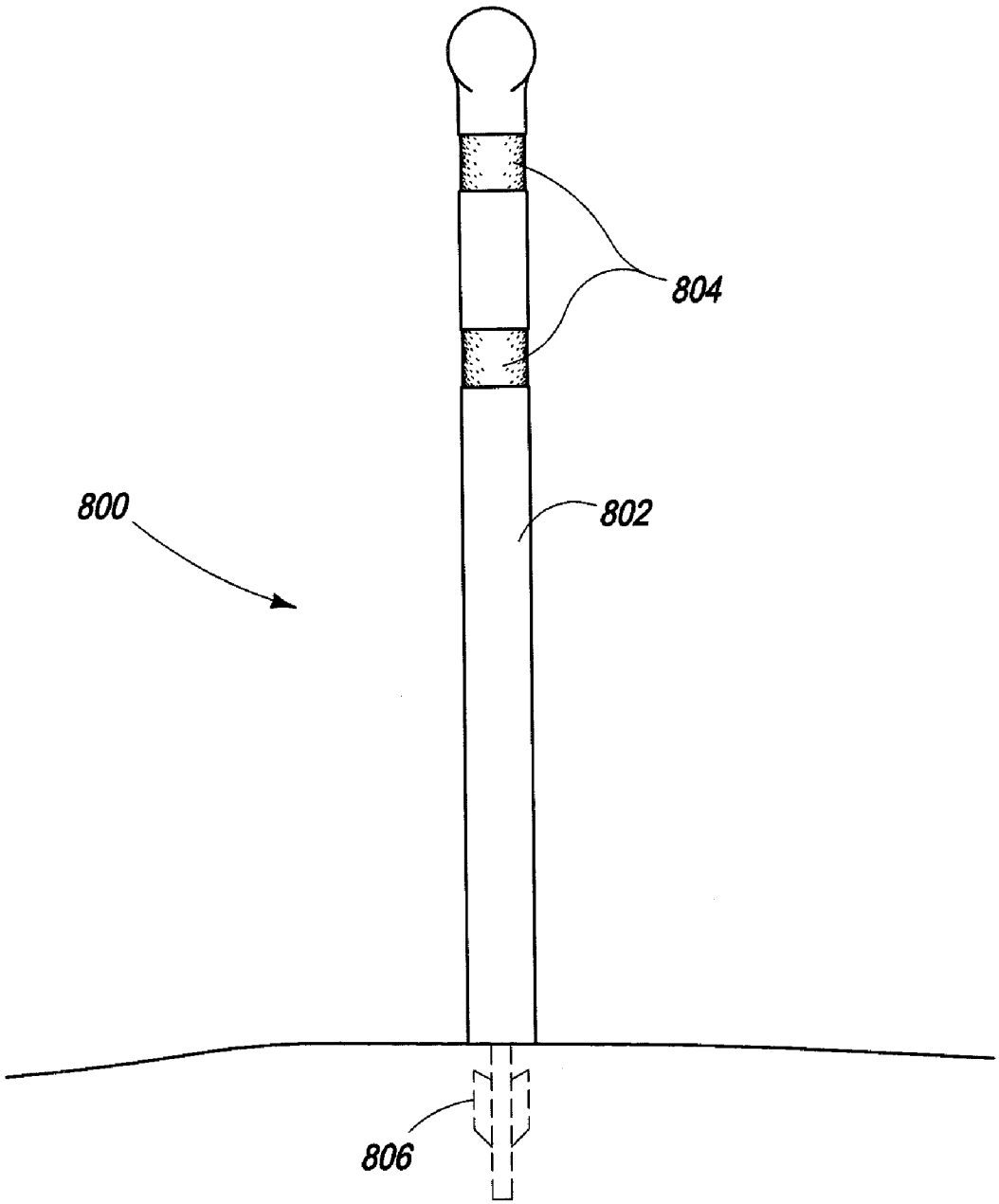
FIG. 8 shows a warning marker post embodiment.

FIG. 8 shows a fourth—warning marker—embodiment 800. Like with the past embodiments, a post 800 is mounted atop (ratcheted over) a standard T-post 806. In this embodiment, a brightly colored body 802 is adapted to clearly inform a party that a hazard may or may not exist. Further, a plurality of reflector tape portions 804 can also be provided in this embodiment. Because it also incorporates an internal corridor and a ratchet system substantially identical to those shown in FIGS. 2-5, the cover 802 enables a warning marker to be quickly and releasably secured onto T-post installed into the ground near a hazard (for example, a hole in landscape, or any other sort of hazard).

Figure 9:
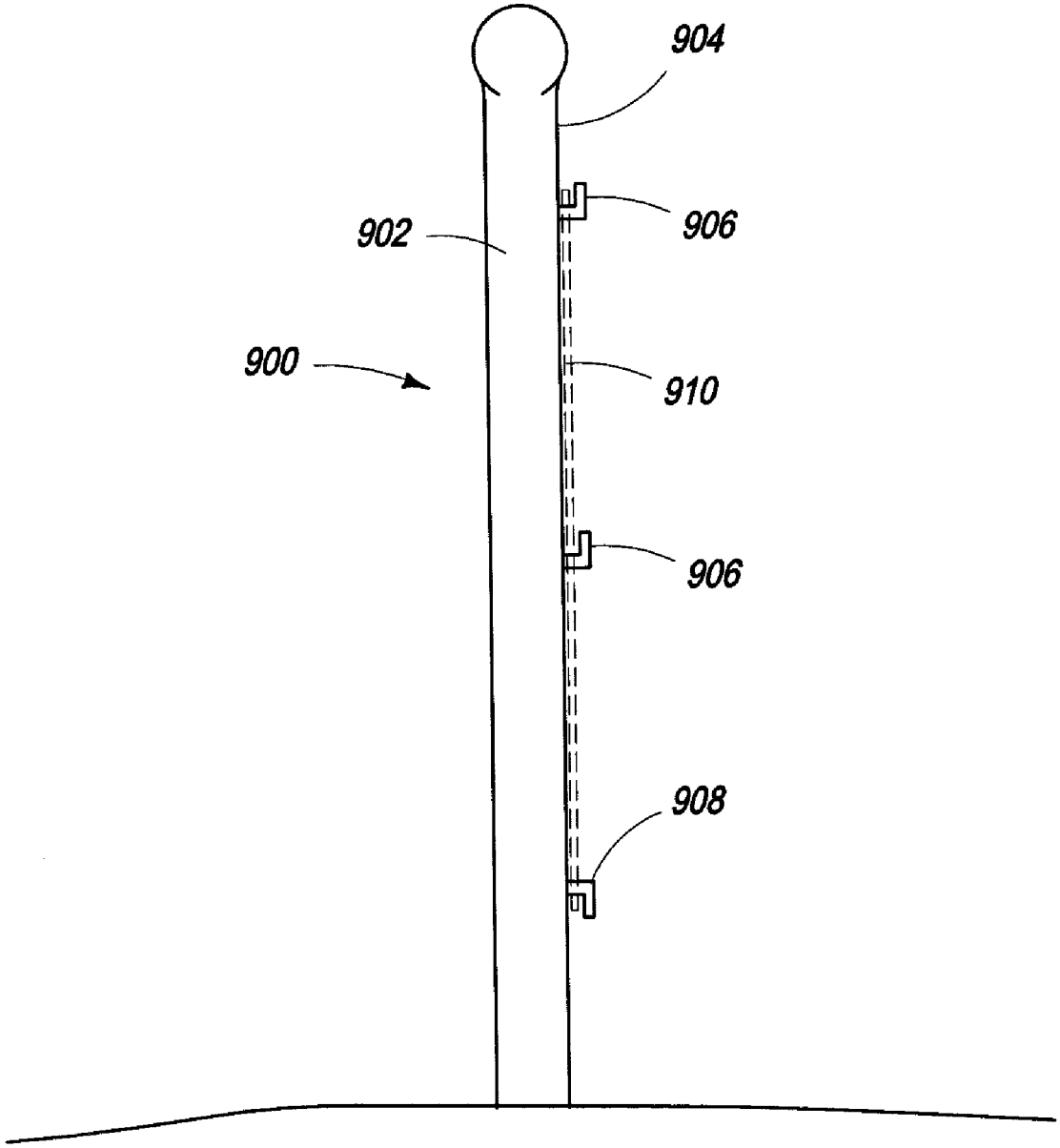
FIG. 9 shows a temporary net-fence post embodiment.

A fifth embodiment 900 for a net-supporting post is disclosed in FIG. 9. The prior art devices used to support a netting (for example, used to temporarily cordon off a hazard) included brittle plastic posts which are fairly thin (e.g., about ¾ inches thick), and thus apt to break. Further, these conventional posts are normally supported by pin or nail-shaped metal bottom supports.

Device 900, however, is thicker, more durable, and easily and quickly installed or removed. It includes a ratcheted-on sports net post 902 which works with a ratcheting system just like all the prior embodiments. Also like with all the past embodiments, the enveloping cover body 902 is secured atop a standard T-post (not shown, but would be buried in the earth beneath post 900) which has been pounded into the ground. The cover 900 is formed to have a body portion 902 which has on a forward portion 904 a plurality of tangs. A first pair of tangs 906 are upwardly projecting, and a third tang 908 projects downward. Together, the tangs 906 and 908 can be used to support a net 910 as shown. It should be understood that the sports net embodiment would include a plurality of posts (like post 900) which would be strategically located around a designated area as a boundary or barrier for exclusion or enclosure, whatever the desired use may be.

Figure 10:
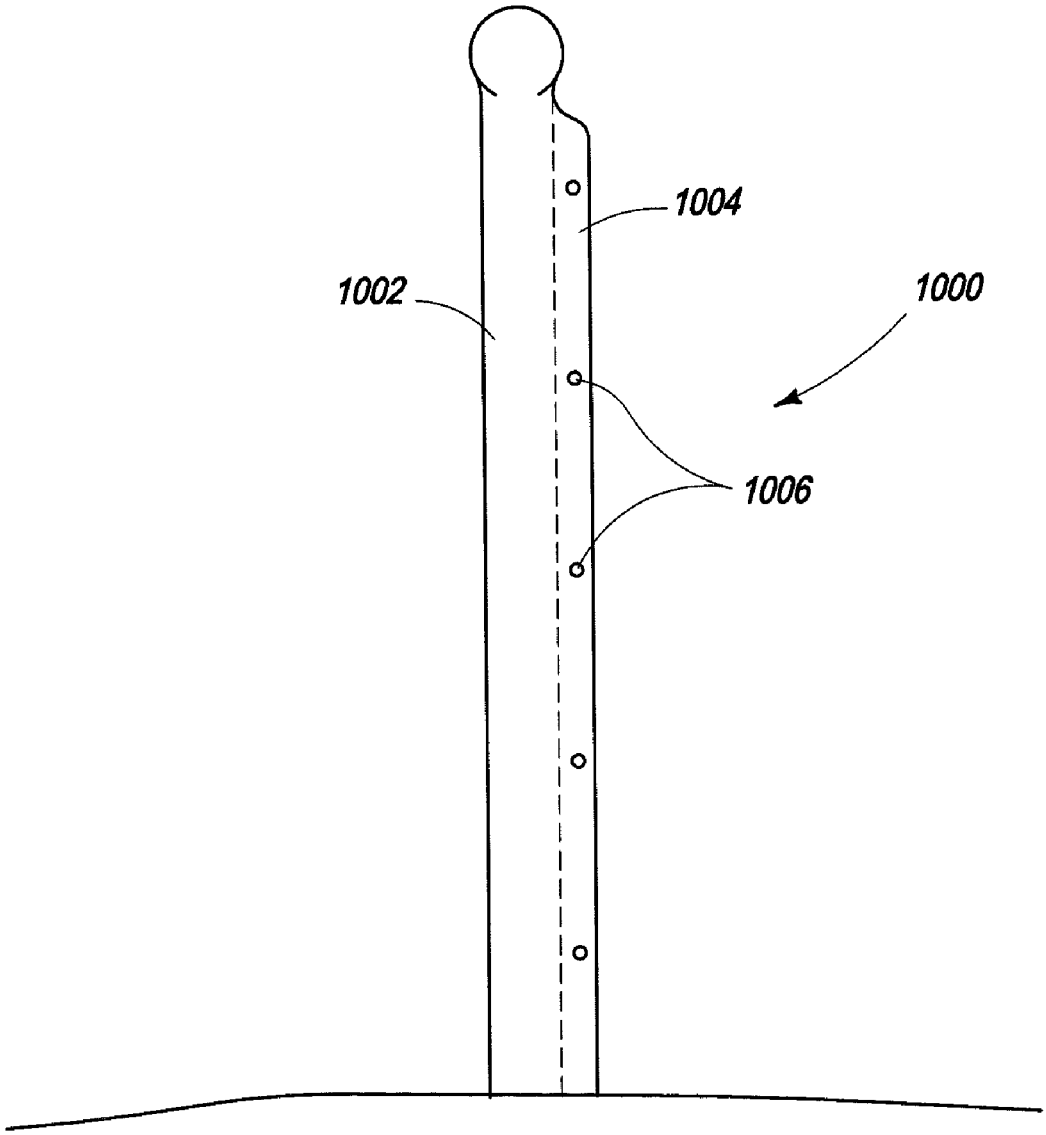
FIG. 10 shows a cable-fence post embodiment.
Figure 11:
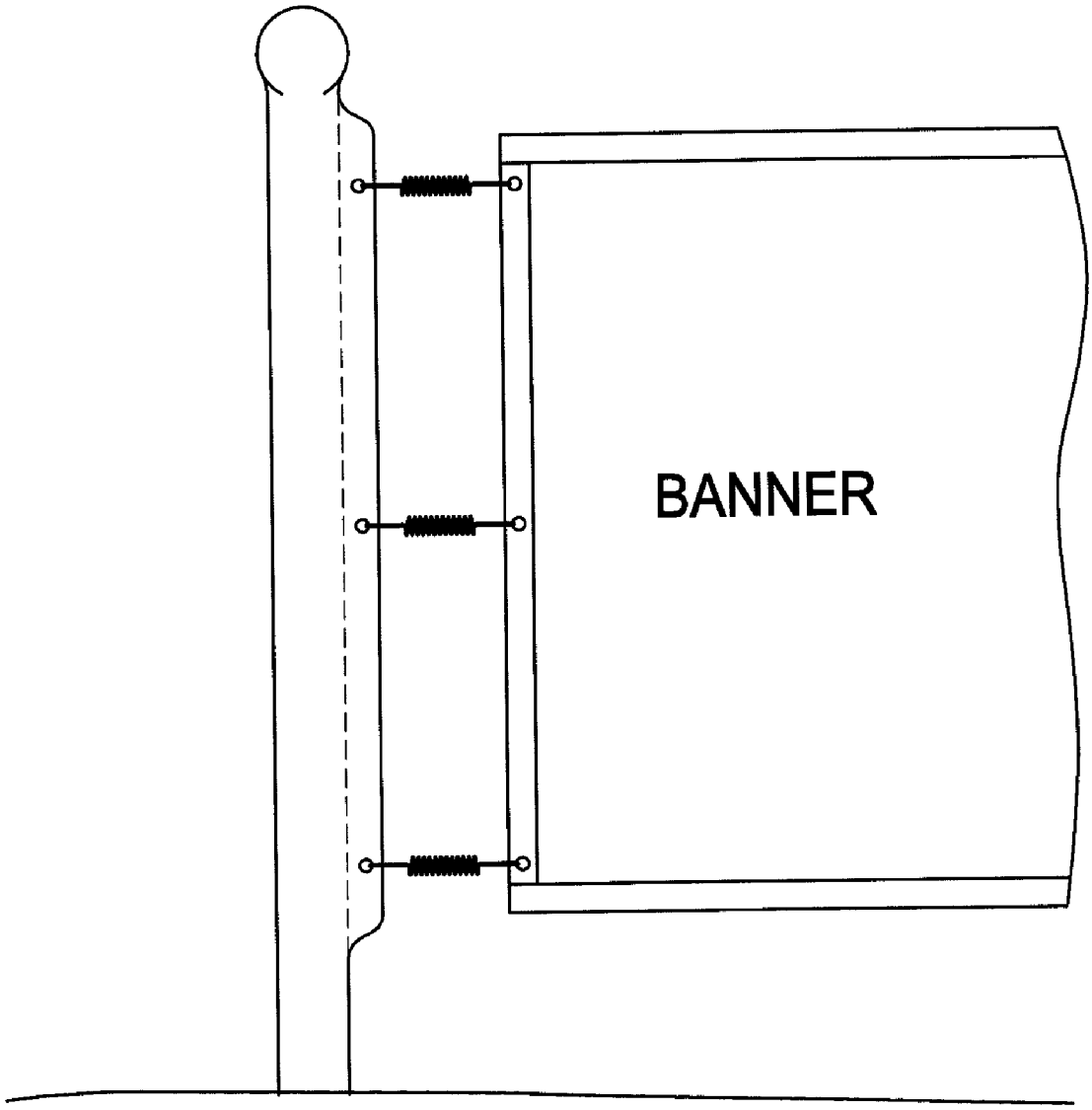
FIG. 11 shows a banner support embodiment.

FIG. 10 shows a cable-fence embodiment enveloping cover arrangement 1000. Each cover 1000 includes a body portion 1002 which is ratcheted on top of a T-post (not shown) as with the past embodiments. The post includes a forward outcropping flange portion 1004 which runs vertically up and down the post 1000 on a forward side and includes a plurality of cable-receiving transverse bores 1006. These bores 1006 are used to receive cabling (not shown) which are used for field or farm fencing arrangements. The cabling is maintained under tension by end posts (not shown) to which the ends of each cable are secured. Those skilled in the art will also understand that turnbuckle arrangements are used to selectively tighten or loosen the tension in cables. The covers can be quickly ratcheted on, and released and provide a desirable ornamental appearance.

Referring now back to the commonalities of all the embodiments in FIGS. 1-10, it should be understood that the ratcheting mechanisms of the present invention enables quick installation. T-posts can be quickly and easily installed (by pounding) into the ground, and the coverings shown can be easily slid over the post. Plus, the catches (e.g., catches 114) on the ratchet strip (e.g., strip 112) lock against the barbs (e.g., barbs 118) to hold the tube on. Upon time for removal, the coverings (e.g., coverings 100, 600, 700, 800, 900, and 1000) can easily be removed by inserting a removal strap, e.g., strap 137) into the upwardly curved slot and between the catches (e.g., catches 114) and barbs (e.g., barbs 118) so that the covering (e.g., covering 100, 600, 700, 800, 900, and 1000) can be removed.

Beyond that, however, there is a significant amount of safety provided in that the tops of T-posts are notorious for causing injury to humans when, for example, a person falls on the top of one, or for some other reason is exposed to the top of the T-Post. With the present invention, the cover used protects people from injury by concealing the T-post with a plastic covering.

Another aesthetical benefit is that the cover looks more pleasing to onlookers than would an exposed T-post. T-posts are unattractive if new, and become even less attractive after being exposed to the elements for a period of time. Thus, a wide variety of post designs, even in addition to those shown in the covering embodiments 100, 600, 700, 800, 900, and 1000 are possible which would fulfill aesthetic objectives.

Another benefit is that T-posts are very inexpensive and commonly available. Additionally, T-posts have been used for years and many are already in service in a variety of applications, e.g., in landscaping and farming applications. For these already-existing T-posts, the covers used can be immediately ratcheted on, or retrofit to save time and improve aesthetics.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A T-post cover comprising:

a body;

a longitudinal corridor defined in said cover, said longitudinal corridor adapted to receive a T-post into said cover;

a locking mechanism on a surface including a catch, said catch having a first position in which said catch extends outward and upward so that said catch is adapted to engage a lower sloped surface of a T-post barb to prevent removal of said cover after installation; and a release mechanism, said release mechanism being made slidable from outside the cover into the corridor through an upwardly-curved slot so that the release mechanism is able to travel up through a gap in the corridor to be slid between said catch and said T-post barb to compel said catch into a second less-extended position thus disengaging said catch from said barb enabling removal of said cover.

2. The cover of claim 1 wherein said release mechanism is a flexible metal strap.

3. A system comprising:

a rigid longitudinal member having a plurality of vertically spaced protrusions, the longitudinal member adapted to be driven into the ground and stand substantially upright such that the longitudinal member has an underground part and an above-ground part;

a cover, said cover slidably receiving said rigid longitudinal member into a longitudinal corridor defined in a body of said cover, said longitudinal corridor including a cross-sectional opening, said cross-sectional opening configured to correspond to cross-sectional shape of said rigid longitudinal member such that said rigid longitudinal member is receivable into said cover and, the cover substantially covering the above-ground part of the longitudinal member;

said cover including a locking mechanism, said mechanism including a plurality of outwardly projecting catches, each catch engaging one of the vertically-spaced protrusions of the rigid longitudinal member to prevent detachment after said cover is installed; and a release mechanism, said release mechanism being receivable in an upwardly-curved slot which directs the release member up through an open area in the cover between the plurality of catches and plurality of vertically-spaced protrusions enabling disengagement of said plurality of catches from the plurality of vertically-spaced protrusions such that said cover is rendered slidably removable from said rigid longitudinal member even when the cover has a lower end which is at or near ground level.

4. The system of claim 3 wherein said rigid longitudinal member is a T-post.

5. The system of claim 3 wherein the vertically-spaced protrusions on the rigid longitudinal member are barbs.

6. The system of claim 5 wherein said rigid longitudinal member is a T-post.

7. The system of claim 3 wherein said plurality of catches each extend outward and upward to engaging a lower sloped face on each of said vertically-spaced protrusions on the rigid longitudinal member.

8. The system of claim 7 wherein:

said plurality of vertically-spaced protrusions are T-post barbs, and said catches are included on a common strip mounted on an inside surface of said longitudinal corridor opposite said T-post barbs.

9. The system of claim 8 each of said catches are punched into then bent outwards from said strip, said strip being constructed of a springable metal.

10. The system of claim 3 wherein said cover is comprised of a plastic.

11. The system of claim 3 wherein said cover includes means to receive a wired used to tether a tree.

12. The system of claim 3 comprising:

a water reservoir formed in said cover;

means to allow for the introduction of water into said reservoir; and means to meter water in said reservoir into the ground.

13. The system of claim 3 wherein said cover is adapted to receive a sign.

14. The system of claim 3 wherein said cover is adapted to serve as a warning marker.

15. The system of claim 3 wherein said cover is adapted to receive and support netting.

16. The system of claim 3 wherein said cover includes apertures used to receive cable used to create a fence.

17. The system of claim 3 wherein said cover defines holes used to receive one of a string, rope, cable, or wire, to help support a banner.

* * * * *